US005564950A

United States Patent [19]

Loman et al.

[11] Patent Number: 5,564,950

[45] Date of Patent: Oct. 15, 1996

[54] DOUBLE-SIDED CONNECTOR FOR CONNECTION TO AN ELECTRICAL CABLE

[75] Inventors: Martinus H. Loman, Oss; Laurentius M. Verhoeven, Veghel, both of Netherlands

[73] Assignee: Berg Technology, Inc., Reno, Nev.

[21] Appl. No.: 262,048

[22] Filed: Jun. 16, 1994

[30] Foreign Application Priority Data

Jun. 16, 1993 [NL] Netherlands ..... 0A93.01050

[51] Int. Cl.[6] ..... H01R 4/24

[52] U.S. Cl. ..... 439/651; 439/404; 439/417

[58] Field of Search ..... 439/401, 404, 439/405, 417, 418, 638, 651

[56] References Cited

U.S. PATENT DOCUMENTS 3,611,264 10/1971 Ellis, Jr. ..... 439/404
4,431,249 2/1984 Frantz et al. ..... 439/404
5,356,307 10/1994 Dechelette ..... 439/417

FOREIGN PATENT DOCUMENTS 0105589 4/1984 European Pat. Off. .
0390450 10/1990 European Pat. Off. .

*Primary Examiner*—P. Austin Bradley
*Assistant Examiner*—Jeffrey T. Knapp
*Attorney, Agent, or Firm*—Woodcock Washburn Kurtz Mackiewicz & Norris

[57] ABSTRACT

A double-sided connector for connection to an electrical cable is provided. According to the invention, the connector comprises two connector parts with connector contacts which are accessible at the front, a positioning mechanism for receiving and positioning the ends of the cable cores and a connecting component for connecting the connector contacts of at least one of the connector parts to the conductors of the cable cores. The connector parts are provided at the back with pin contacts and socket contacts, respectively, which extend perpendicularly to the backs and can be connected back-to-back through a common housing.

16 Claims, 4 Drawing Sheets

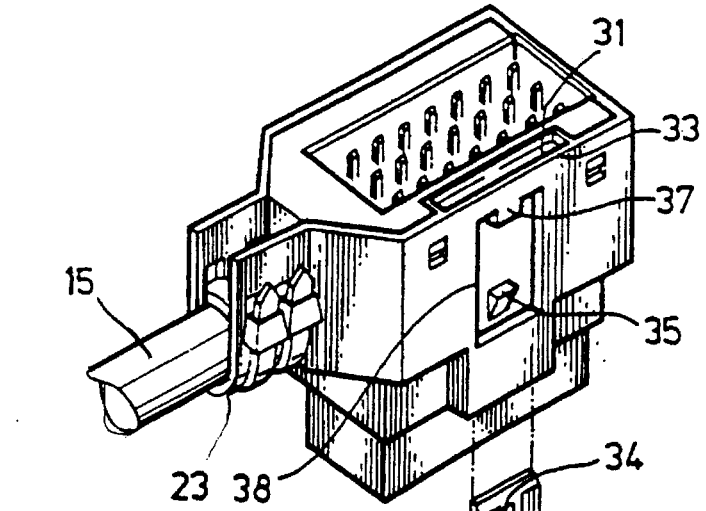
fig-7a
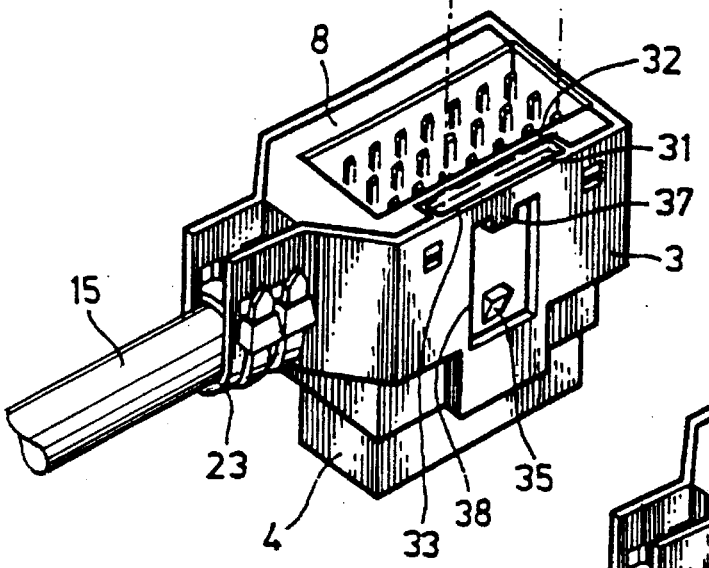
fig-7b
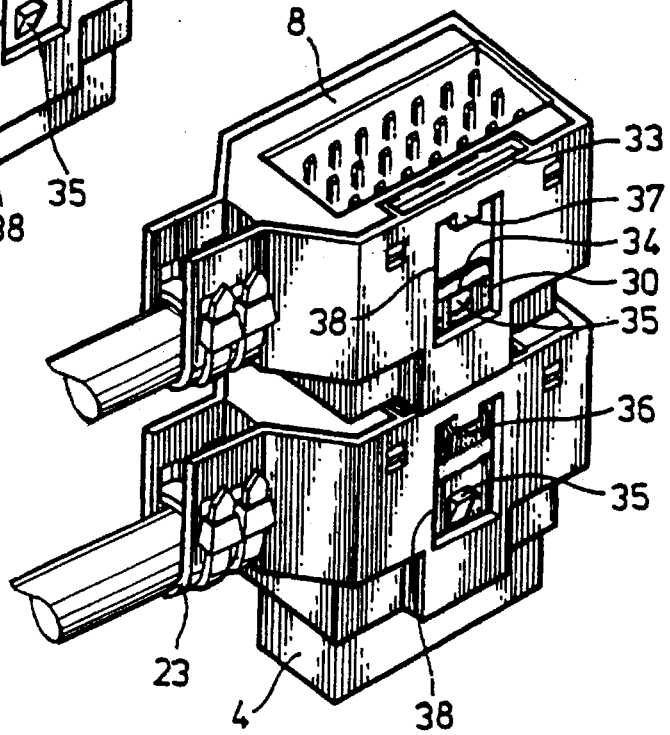

DOUBLE-SIDED CONNECTOR FOR CONNECTION TO AN ELECTRICAL CABLE

FIELD OF THE INVENTION

The invention relates to a double-sided connector for connection to an electrical cable and, more particularly, to a connector having two connector parts capable of direct connection back-to-back through a common housing.

BACKGROUND

In a known connector, such as the connector disclosed in U.S. Pat. No. 4,431,249, the connector contacts are connected to one another and to respective cable conductors. For this purpose, a positioning means in the form of a separate positioning block is present. The ends of the cable cores are received and positioned in the positioning block. Two connector parts are provided with connecting means which are designed as insulation-removing contacts which are electrically connected to the corresponding connector contacts.

During the assembly of the connector, the two connector parts are pressed onto the positioning block with their respective backs facing one another. In the process, the insulation is removed from the cable conductors by the insulation-removing contacts and, in doing so, contact is made between the cable conductors and the connector contacts of the two connector parts. The connector parts pressed onto each other are enclosed in a two-part housing with the separate positioning block in between.

There is a need to provide a double-sided connector in a simpler and less expensive manner.

SUMMARY OF THE INVENTION

According to the invention, this need is achieved in that the connector parts are provided at the back with pin contacts and socket contacts, respectively, which extend perpendicularly to the backs and can be mutually inserted. Both pin and socket are connected to the corresponding connector contacts of the associated connector part.

As a result of using the insertable pin contacts and socket contacts, respectively, only one of the connector parts requires a means for connecting the connector contacts of the connector parts to the conductors of the cable cores. Therefore, the design of the positioning means can be made simpler.

BRIEF DESCRIPTION OF THE DRAWINGS

The present invention will be better understood, and its numerous objects and advantages will become apparent by reference to the following detailed description of the invention, when taken in conjunction with the following drawings, in which:

FIG. 7 shows an assembly of two connectors according to the invention, the connector in FIG. 7*a* being shown in the disassembled state and that in FIG. 7*b* in the assembled state.

DETAILED DESCRIPTION OF THE INVENTION

The connectors shown in the figures represent only particularly advantageous embodiments of the invention. Since various embodiments are, of course, possible within the scope of the invention, the present invention should not be limited to the drawings as shown in the figures.

Figure 1A:
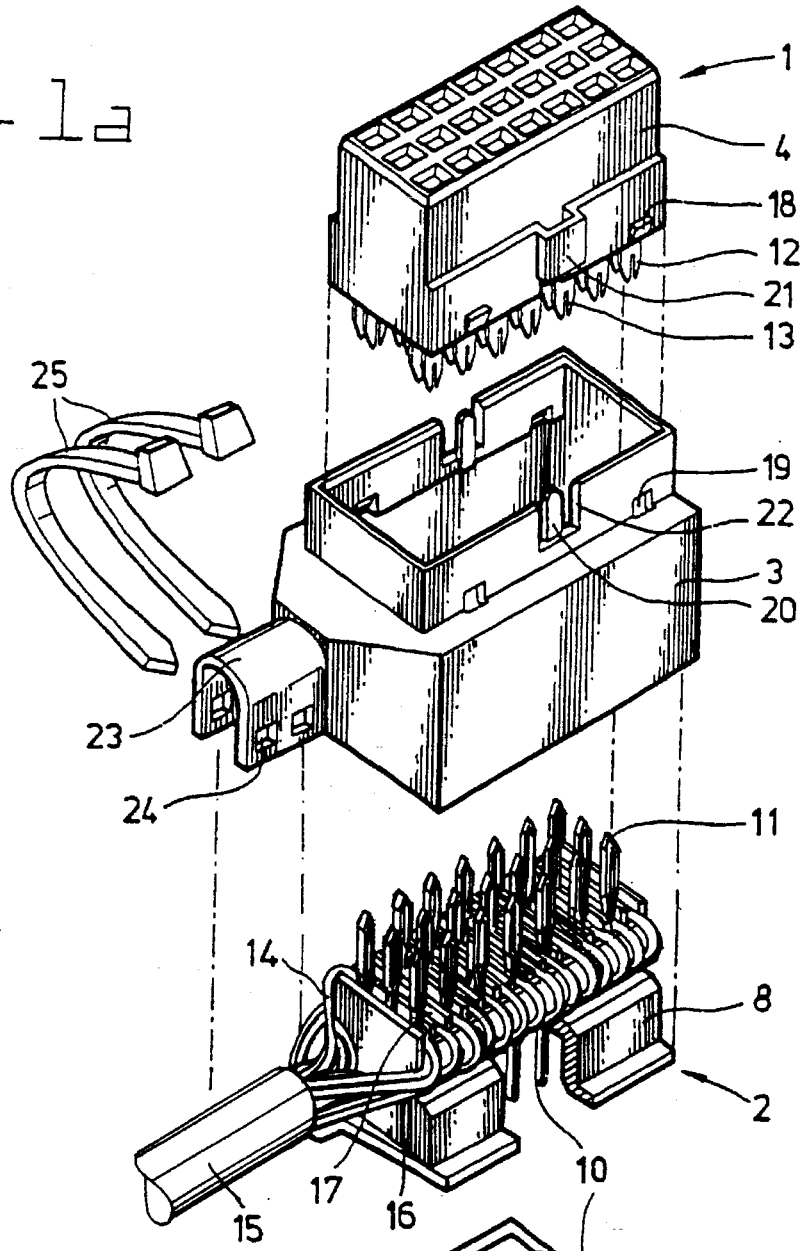
FIG. 1 shows an embodiment of a double-sided connector according to the invention, the connector being shown in disassembled components in FIG. 1*a* and in the assembled state in FIG. 1*b*.
Figure 1B:
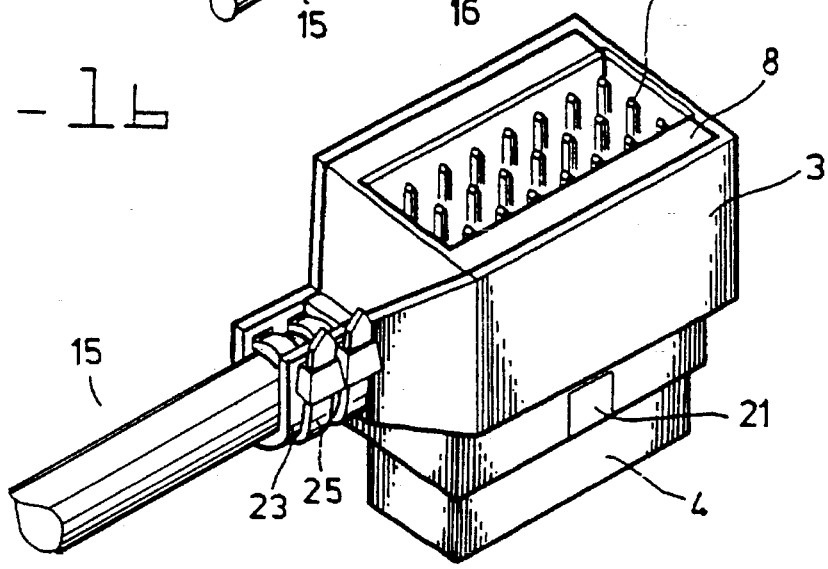

The embodiments shown in the figures of a double-sided connector according to the invention comprise two connector parts 1, 2 and a common housing 3. FIG. 1*a* shows an exploded view of the connector parts 1, 2 and the common housing 3 whereas FIG. 1*b* shows the connector parts 1, 2 and housing 3 after assembly.

Figure 2:
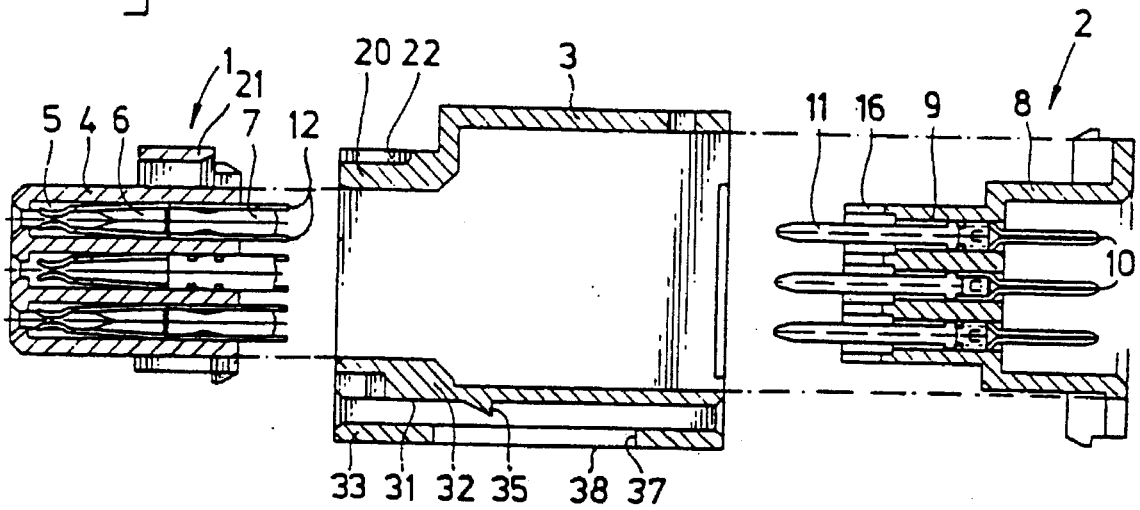
FIG. 2 shows a section through the connector shown in FIG. 1 with disassembled components.
Figure 3:
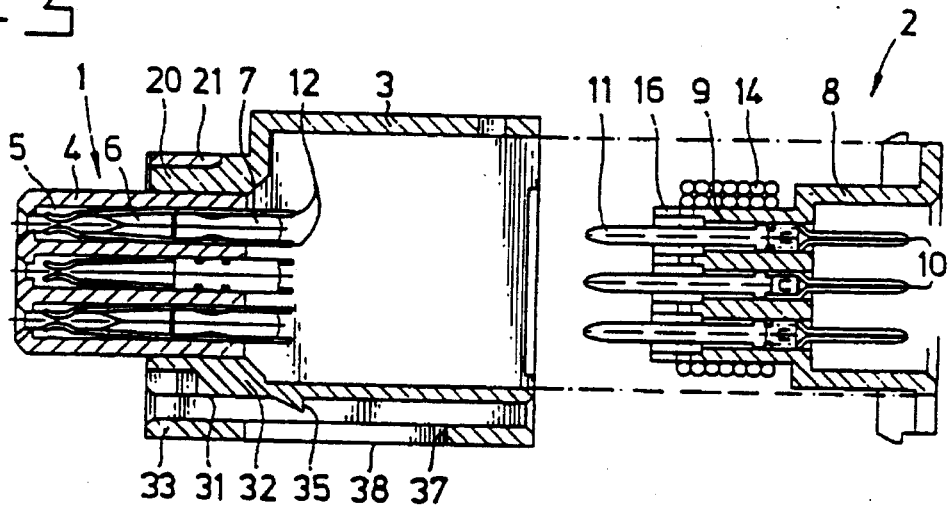
FIG. 3 shows a section through the connector shown in FIG. 1, one connector part being locked in the housing.
Figure 4:
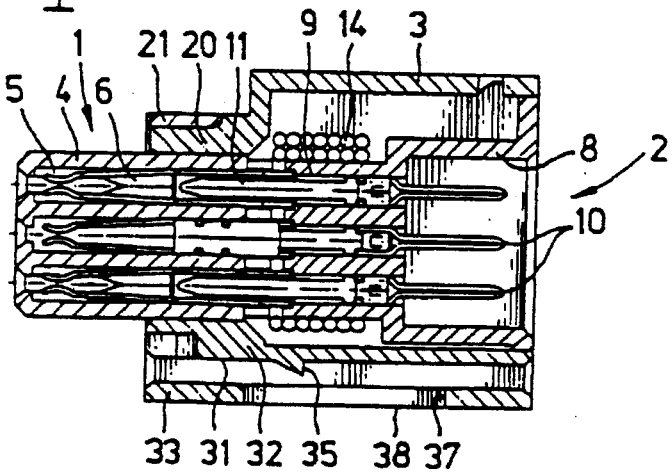
FIG. 4 shows a section through the assembled connector shown in FIG. 1.

FIGS. 2–4 show a cross-section of the connector according to the invention in stages as it is assembled. The connector part 1 comprises a connector part housing 4 in which two rows of bores 5 are provided in which connector socket contacts 6 are received in a locked manner. Connecting pins of a printed circuit board or other connector can be inserted in the connector socket contacts 6 from the front of the connector part 1. Socket contacts 7 which are electrically connected to the connector socket contacts 6 are accommodated in the bores 5. The socket contacts 7 are accessible to pin contacts via the back of the connector part 1.

The connector part 2 comprises a connector part housing 8 in which connector pin contacts 10, which are accessible at the front of the connector part 2 for interaction with socket contacts of one connector or another, are fitted in bores 9. Also situated in this bore 9 are pin contacts 11 which are electrically connected to the pin contacts 10. In the assembled state of the double-sided connector, the pin contacts 11 are plugged into the socket contacts 7, so that the backs of the connector parts 1, 2 face one another. Additionally, plug-in connections can be made at the front of each connector part 1 and 2. It should be understood that the connector may also comprise connector parts 1 and 2 which may both be provided with connector socket contacts or connector pin contacts. By the plug-in connection between the socket contacts 7 and the pin contacts 11, an electrical connection is also obtained between the connector contacts of the two connector parts. Thus, a connection between the cable cores of the cable and the connector contacts requires only contact between the conductors of the cable cores and the connector contacts of only one of the connector parts 1, 2. Therefore, only one of the connector parts needs to be provided with conductor connecting means.

In the connector shown in the figures, the connector part 1 is provided with insulation-removing contacts 12. The contacts 12 are provided with a slot 13 forming sharp edges. The slot is dimensioned so that when a cable core is pressed in the slot, the insulation is removed locally therefrom and contact is made with the conductor of the cable core. The insulation-removing contacts 12 extend perpendicularly to the back face of the connector part 1 concerned and perpendicularly to the positioned cable cores, and are electrically connected to or form a single entity with the socket contacts 7.

In order to position and fix the ends of the cable cores 14 of the cable 15 in the correct position, the back of the connector part 2 is provided with positioning slots 16. The slots are bounded by the back of the connector part housing 8 and projections 17 extending from the back of the connector part housing 8.

As a result of mutually inserting the connector parts 1 and 2, the insulation-removing contacts 12 with the slots 13 fit over the cable cores clamped in the positioning slots and make contact with the conductors situated therein. Although it is preferable for the insulating-removing contacts 12 to be provided at the back of the connector part with the socket contacts 7, it is also conceivable that the insulation-removing contacts are situated at the back of the connector part provided with the pin contacts.

Preferably, the socket contacts 7 of the connector part 1 are provided with two insulation-removing contacts 12 which extend parallel to one another. This achieves a still more reliable connection between the socket contacts 7 and the cable conductors.

The connector parts 1 and 2 can respectively be pushed in from two sides of the common housing 3 which comprises only one part. The connector part 1 is locked to the housing 3 in the final pushed-in position. The connector part 1 is provided with locking projections 18 and the housing is provided with locking recesses 19 which intersect to lock the connector part 1 to the housing. The housing 3 is provided, moreover, with guide pins 20 which are received in a space which is bounded by the U-shaped feed part 21 of the connector part 1 to guide the connector part 1. The U-shaped feed part 21 fits into the recess 22 in the wall of the housing 3. As a result of the interaction of the feed part 21 of the connector part 1 and the recess 22 in the housing 3, the final pushed-in position of the connector part 1 in the housing 3 is also defined.

Figure 6:
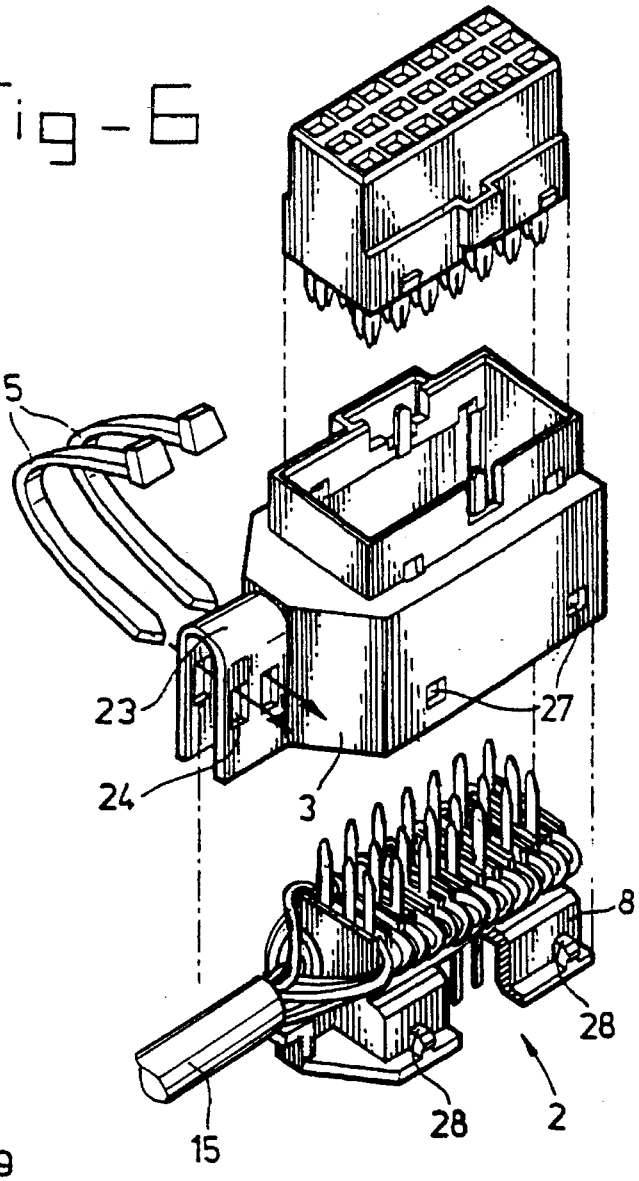
FIG. 6 shows a further elaboration of the connector.
Figure 8:
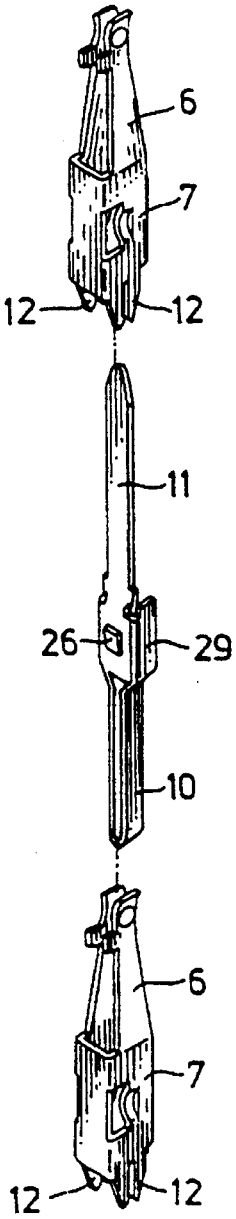
FIG. 8 illustrates various contacts of the assembly 5 shown in FIGS. 7*a* and 7*b*.

The connector part 2 is received in the remaining space of the common housing 3 and, if desired, locked therein, which, although not shown, may take place in a similar way by means of locking projections and locking recesses. The socket and pin contacts of connector parts, and respectively fit into one another in a clamping manner to hold the connector parts in position. Attaching cable 15 to the housing also provides a means to hold the connector part 2 in position with the housing 3. For this purpose, the common housing 3 is provided with a channel-type feed part 23 in which a portion of the cable 15 is received when the connector part 2 is fitted in the common housing 3. The channel-type feed part 23 is provided with holes 24 through which a fixing strip 25 can be inserted in order to secure the cable 15 in the channel-type feed part 23. In the embodiment shown, fixing strips 25 known per se are used. In practice, it may be desirable to use an additional locking mechanism between connector parts 2 and common housing 3. FIG. 6 shows an example of a double-sided connector utilizing a second locking mechanism. In particular, locking projections 28 are provided on housing 8 and corresponding locking recesses 27 are provided in housing 3. The locking projections and corresponding recesses may be press-fit to lock the connector part 2 to housing 3 as described above.

Referring back to FIGS. 2, 3 and 4, various stages of assembly of the connector according to the invention are shown. The connector is assembled by first pushing the connector part 1 into the common housing 3 until feed part 21 comes up against the innermost edge of the recess 22 of the housing 3. At the same time, the connector part 1 is locked to the common housing 3 in this limited pushed-in position by means of the mutually fitting locking projections 18 and locking recesses 19 (see FIG. 1*b*). The cable cores 14 of the cable 15 are bared over a predetermined distance and the ends of the cable 14 are pressed into, and secured in a clamping manner, in the positioning slots 16 in the back face of the connector part housing 8 (see FIG. 3). The connector part 2, provided with the cable 15, is then pressed into the common housing 3, as a result of which a connection is brought about between the connector socket contacts 5 and the connector pin contacts 11 of the respective connector parts 1, 2 by means of the socket contacts 7 and the pin contacts 11.

At the same time, the insulation-removing contacts 12 with the slots 13 thereof are pushed over the secured cable cores 15 and, as a result, the insulation is removed locally from the cable cores 14 and a contact is brought about between, on the one hand, the connector socket contacts 6 and the connector pin contacts 11 of the respective connector parts 1 and 2 and, on the other hand, the conductors in the cable cores 14.

When the connector part 2 is placed in its position in the common housing 3, a portion of the cable 15 falls into the channel-type feed part 23 of the housing 3, after which the fixing strips 25 are inserted into the channel-type feed part 23 and secured.

Figure 5:
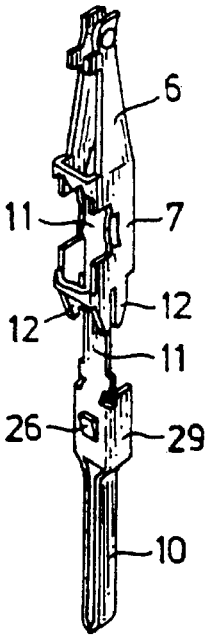
FIG. 5 shows an embodiment of the contacts of the connector parts.

In particular, the form of the contacts of the connector parts 1 and 2 and also the operation thereof is evident from FIG. 5.

The contacts of the connector part 1 are formed from the receiving contacts 6 and the receiving contacts 7 which, in this case, form a single entity with the insulation-removing contacts 12. This entity is received in the recesses 5 of the connector part housing 4 (see FIGS. 1–4).

The contacts of the connector part 2 are also formed as a single entity in this embodiment. The plug-in contacts 10 and 11 are mutually connected by a central piece 29 that provides a locking projection 26 on one side. The locking projection 26 falls into a locking recess (not shown) associated therewith in the wall of the bore 9 in the connector housing 8 of the connector part 2. When the two connector parts are pushed into one another in the common housing 3, the plug-in contact 11 is pushed into the receiving contact 7. In FIG. 5 these contacts are shown in the partly pushed-in state.

The embodiment shown in FIG. 6 of the connector according to the invention essentially corresponds to the embodiment of FIG. 1 so that corresponding parts are not provided with reference numerals. The connector part housing 8 of the connector part 2 is provided with locking projections 28 which are intended to fit into the locking recesses 27 of the common housing 3 when the connector part 2 is pushed into the common housing 3 as described above.

In FIG. 7*a* two connectors according to the invention are shown in the disassembled state, while the assembly of the connectors is shown in FIG. 7*b*. A locking element 30 is used to mutually lock assembled connector. Corresponding parts of the connectors have not been provided with reference numerals, since only the method of locking the assembled connectors will be described, according to the invention. The locking element 30 may be partly received in a space 31 which is bounded by an innermost wall 32 and an outermost wall 33 of one side of the common housing 3 as shown in FIGS. 2, 3 and 4. The remaining part of the locking element 30 is received in the corresponding space of the common housing 3 of the other connector. In a preferred embodiment, locking element 30 is T-shaped as is shown in FIGS. 7*a* and 7*b* and the space 31 of the common housing 3 is likewise T-shaped. The locking element 30 is provided with a locking recess 34 into which a locking projection 35 provided on the innermost side wall 32 of the common housing 3 fits when the connectors are pushed into one another. Moreover, the locking element 30 is provided with a locking projection 36 which fits behind the locking projection 37 which is formed in the window 38 in the outermost side wall 33 of the common housing 3. That part of the locking element 30 that is provided with the locking projection 36 is received in the wider portion of the T-shaped space of the common housing 3. This wider portion of the space 31 forms a plug-in limitation of the locking element 30.

While the invention has been described and illustrated with reference to specific embodiments, those skilled in the art will recognize that modification and variations may be made without departing from the principles of the invention as described hereinabove and set forth in the following claims.

It is claimed:

1. A double-sided connector for connecting a cable, said cable having a number of cable cores with a conductor disposed therein, the connector comprising:

a first connecting part having a front and back and comprising a plurality of connector contacts accessible at the front and a plurality of socket contacts coupled to the connector contacts and accessible at the back, said socket contacts being disposed perpendicular to the back of said first connecting part;

a second connecting part having a front and a back and comprising a plurality of connector contacts accessible from the front and a plurality of pin contacts coupled to the connector contacts and accessible from the back, said pin contacts being disposed perpendicular to the back of said second connecting part, wherein said pin contacts are capable of plugging into said socket contacts to form an electrical connection therebetween;

a positioning means coupled to at least one of said connector parts for receiving and positioning a number of cable cores; and a connecting means cooperating with the positioning means to connect the conductors of the cable cores to the connector contacts of at least the other connecting part.

2. The connector of claim 1, wherein said connecting means comprises insulation removing contacts associated with only one of said connecting parts and coupled to the connector contacts thereof for removing the insulation from the cable cores to form an electrical interface between the conductors of the cable cores and the connector contacts coupled thereto.

3. The connector of claim 2, wherein the connector means is coupled to the first connector part.

4. The connector of claim 3, wherein the socket contacts are provided with two insulation-removing contacts extending at a distance from one another.

5. The connector of claim 3, wherein the positioning means is formed by slots in the back of said second connector part.

6. The connector of claim 5, wherein the slots are bounded by projections projecting from the back of the second connector part.

7. The connector of claim 1, further comprising:

a common housing having two mutually situated opposite sides with openings for insertably receiving the connector parts back-to-back by receiving each of the connector parts through a corresponding one of the openings of the common housing.

8. The connector of claim 7, wherein said first connector part provides at least one recess and at least one locking projection, the common housing comprising:

a guide pin capable of being received in the recess; and at least one locking recess capable of receiving at least the one locking projection to lock said first connecting part to the common housing.

9. The connector of claim 7, wherein said second connector part provides at least one locking projection and the common housing provides at least one locking recess capable of receiving at least the one locking projection to lock said second connecting part to the common housing.

10. The connector of claim 7, wherein the common housing is provided with cable-fixing means.

11. The connector of claim 7, wherein at least one side of the common housing is at least partly double-walled for bounding a space which is open at the outside edges of the opening for the respective connector parts so that a locking element can be received in a lockable manner.

12. The connector of claim 11, wherein the space is T-shaped.

13. A connector having a first and a second connector part, each connector part having a plurality of connector contacts associated therewith, the connector comprising:

a connecting means coupled to the connector contacts of only said first connector part; and a positioning means formed in said second connector part for positioning a number of cable cores, each cable core having a conductor and an insulator surrounding the conductor, said positioning means cooperating with said connecting means to electrically interface said plurality of connector contacts associated with each connector part with the conductors of the cable cores so positioned.

14. The connector of claim 13, wherein said connecting means comprises two insulation-removing contacts coupled to the connector contacts associated with said first connector part.

15. The connector of claim 13, wherein said first connector part comprises socket contacts coupled to the connecter contacts associated with said first connector part and said second connector part comprises pin contacts coupled to the connector contacts associated with said second connector part, said pin contacts capable of plugging into said socket contacts to electrically interface the connector contacts associated with said first connector part with the connector contacts associated with said second connector part.

16. The connector of claim 13, further comprising:

a common housing having an opening in each of two oppositely situated sides of said common housing, said first connector part being receivable through the opening in one of the sides and said second connector part being receivable through said opening in the other side, said connector parts capable of being connected back-to-back within said housing so that the connector contacts associated with each of said connector parts remain accessible.

* * * * *